United States Patent [19]

Takatori et al.

[11] 4,133,280

[45] Jan. 9, 1979

[54] AUTOMATIC METHOD AND APPARATUS FOR CLOSING A TOE END OF A HOSE UTILIZING A STRAIGHT LINE STITCH

[75] Inventors: Osho Takatori, Nara; Etsuo Nishikawa, Goze; Yosinobu Fukuyama, Kashihara, all of Japan

[73] Assignee: Takatori Machinery Works, Ltd., Yamatotakada, Japan

[21] Appl. No.: 767,486

[22] Filed: Feb. 10, 1977

[30] Foreign Application Priority Data

Oct. 26, 1976 [JP] Japan ..... 51-127773
Oct. 26, 1976 [JP] Japan ..... 51-127774

[51] Int. Cl.[2] ..... D05B 21/00; D05B 97/00
[52] U.S. Cl. ..... 112/262; 112/121.15
[58] Field of Search ..... 112/121.15, 121.12, 112/121.11, 121.26, 121.29, 262; 223/43, 112

[56] References Cited

U.S. PATENT DOCUMENTS 3,859,938 1/1975 Fukuyama ..... 112/121.15
3,875,880 4/1975 Hazelgrove et al. ..... 112/121.15
3,941,069 3/1976 Fukuyama ..... 112/121.15 X
3,952,673 4/1976 Fukuyama ..... 112/121.15
4,020,775 5/1977 King et al. ..... 112/121.15

FOREIGN PATENT DOCUMENTS 2275164 1/1976 France ..... 112/121.15

*Primary Examiner*—H. Hampton Hunter
*Attorney, Agent, or Firm*—Kenyon & Kenyon

[57] ABSTRACT

Disclosed is an invention relating to a method and an apparatus for closing the toe end of a hose material, wherein the toe portion of the hose material is united in such a way that the toe portion can be closed with a straight line stitching after the material is spread out laterally and caused to travel in a lateral direction.

A photocell-type detecting device is also disposed near one end of the suction tubes of the holding units so as to detect the presence or absence of the end of a hose material within the tube. This detecting device serves to shut off the winding-on means which pulls the hose material onto the holding unit from within the suction tube.

20 Claims, 25 Drawing Figures

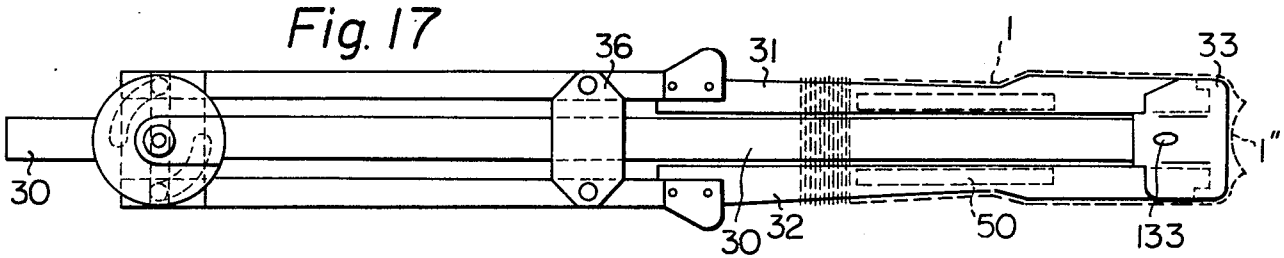
Fig. 17
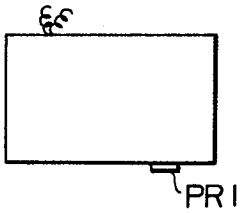
Fig. 18
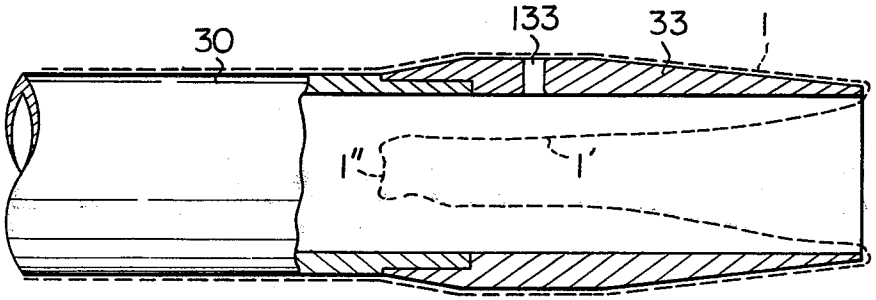

AUTOMATIC METHOD AND APPARATUS FOR CLOSING A TOE END OF A HOSE UTILIZING A STRAIGHT LINE STITCH

The present invention relates to an automatic method and an apparatus for uniting a hose material so as to form a toe thereof for the manufacturing of toe-closed seamless stockings or united panty stockings and, more particularly, relates to an automatic method and an apparatus for carrying out the toe-closing operation on a plurality of hose materials arranged equally spaced from each other while travelling continuously. The toe-closing operation can be carried out with a high degree of efficiency, thus causing the device of the present invention to be a highly productive one.

It is well known that several automatic apparatuses for sewing or closing the material at the toe of a hose material (hereinafter, these apparatuses will be referred to as toe-closers) have been proposed for practical applications in the hosiery industry. For example, in the apparatus disclosed in U.S. Pat. Nos. 3,941,069 and 3,952,673, the toe end portion of the hose material, which is already turned inside-out, is spread out and held by a pair of finger pieces, then gripped by a clamping member of a sewing machine, and thereafter, the finger pieces are retracted into their retracted positions. In this condition, the toe end portion is closed by means of a sewing machine, and then the toe-closed hose material is released from the grip of the clamping member. Finally, the material is conveyed by a suction air flow to a successive working station, after the material has been turned from inside-out and back to its original side.

Recently, there has been an increasing tendency for women to wear the so-called panty-stockings made from synthetic fiber materials used for seamless stockings. In the process of manufacturing these panty-stockings, several automatic sewing machines for combining a pair of cylindrically-shaped hose materials to make the hip portion of the panty-stockings have been developed. Some of these sewing machines sold on the market are widely used. However, a device of U.S. Pat. No. 3,941,069, has already been put into practical use, the production rate of this type of machine being only 400 dozen in 8 hours. Such productivity is still limited, even if this machine uses a stationarily-disposed sewing machine which can clamp the material from above and below by using a clamping member which turn the clamping member so that the material is turned together with the clamping member for carrying out the stitching operation, because the lateral traversing motion of the material is inevitably interrupted.

Furthermore, some of the recently used sewing machines employed as toe-closers are provided with clamping members for closing or stitching the toe of the material in the form of a rounded edge. Sometimes, the sewing machine itself is mounted on a sewing device which can traverse along a circular passage. However, it is very troublesome to turn a material or to traverse a sewing machine along a given circular passage. The above-mentioned two drawbacks must, therefore, be overcome.

The object of the present invention is to obviate the above-described drawbacks, and to make a toe-closed hose material which has a good configuration in the closed toe portion such that a consumer will find satisfaction with the completed, well-matching and properly-sized hosiery products thereof.

In the present method, a material can be toe-closed by a straight line stitching after the material has been moved laterally, during which time the material is properly deformed. In this way, a toe-closed hose material thus produced will have a good configuration in the toe portion as mentioned above. In this particular case, the cutting out of the unused portion from the toe-closed material can be carried out simultaneously together with the stitching operation. In order to perform the toe-closing operation, it is important to arrange the portion to be closed beyond the outer ends of finger-pieces, and also to spread the portion as well as the leg portion of the material laterally by means of finger pieces inserted within the material, so that the portion to be toe-closed is deformed into a concave configuration, which deformation can take place due to the elasticity of the material.

If the above concavely-deformed curve is of a larger radius than the desired radius, it is then possible to further deform the toe portion by utilizing a deforming pin assembly to obtain a desired curve with a smaller radius.

After deforming the portion of the hose material to be toe-closed in a desired concavely-deformed curve, the portion is stitched along a straight line. Consequently, the stitched line on the hose material of the present invention is that of a straight line stitching. When the toe-closed hose material thus toe-closed by the above method is freed from the device of the present invention, such toe-closed hose material will have a toe-portion which exhibits a good configuration.

In addition to this, a stitched line is perpendicularly directed to the center line of the material. This stitching can be carried out by moving the material laterally along a straight line passage. Consequently, when such deformed hose materials are arranged side by side, the toe-closing operation can be carried out one by one when moving the materials simultaneously and laterally. This means that there is no interruption of the lateral travelling of the materials, even when one of the hose materials is being toe-closed. An example of the time duration necessary for toe-closing a material using the device of the present invention is that of only an interval of two seconds. Therefore, a two-second interval is necessary to feed a hose material to the sewing machine. At this rate, about a 50 percent speed-up can be expected over the production rate of the conventional machines. Further, the production rate of the machine using the device of the present invention may be as high as 600 dozens in 8 hours.

A method and an apparatus for manufacturing a pair of toe-closed seamless stockings according to the present invention as mentioned above, can both be equally employed in the manufacturing of a pair of toe-closed panty stockings by means of the same process.

One united panty hose material, which consists of two adjacent legs, is mounted onto two adjacent holding devices, each holding device consisting of a holding member and a pair of finger pieces. One leg of the united hose material is arranged on one holding device, and the other leg of the united hose material is arranged on the other adjacent holding device.

A preferred embodiment of the invention will now be described by way of examples and with reference to the accompanying drawings, in which:

FIGS. 1 through 3 show three different arrangements of the holding device and the hose material of the present invention, wherein FIG. 1 shows the finger pieces being first covered by the hose material;

FIG. 2 shows the finger pieces being spread laterally, and;

FIG. 3 shows a straight line stitching being applied to the hose material after the finger pieces together with the hose material have entered into the stitching line of the sewing machine;

FIGS. 5 (A, B, C) shows several arrangements of the holding member unit and the suction tube according to the present invention, wherein

Figure 1:
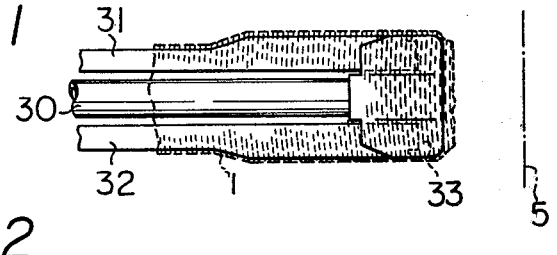
Figure 2:
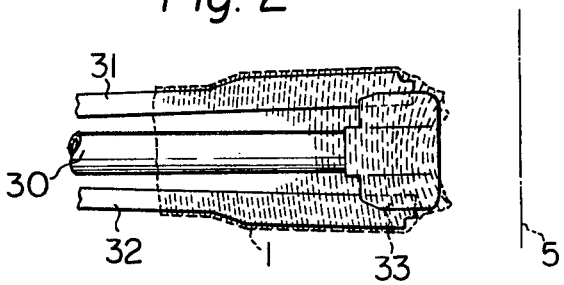
Figure 3:
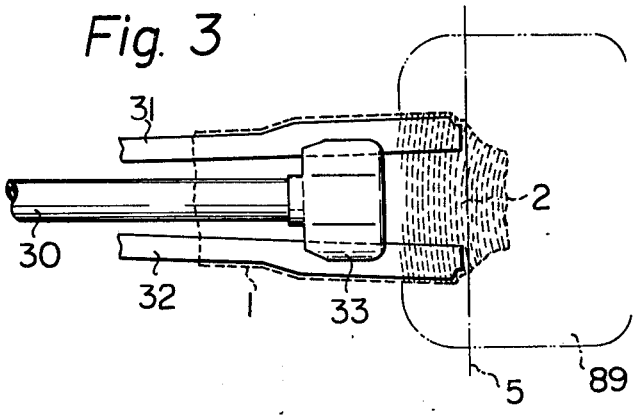
Figure 4:
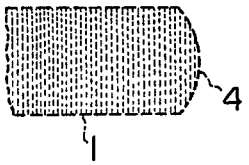
FIG. 4 shows a toe-closed hose according to the present invention.
Figure 6:
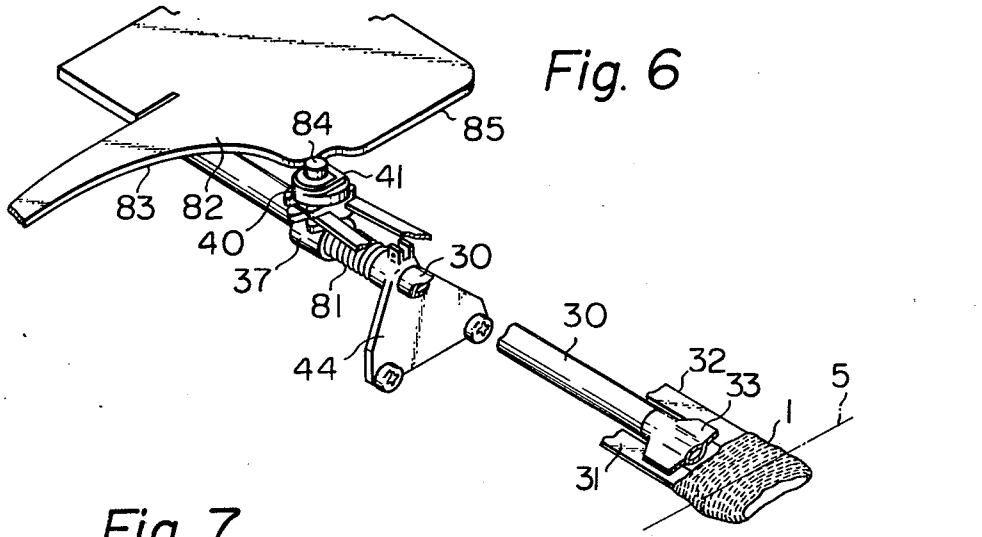
FIG. 6 is a perspective view of an embodiment of the present invention.
Figure 9:
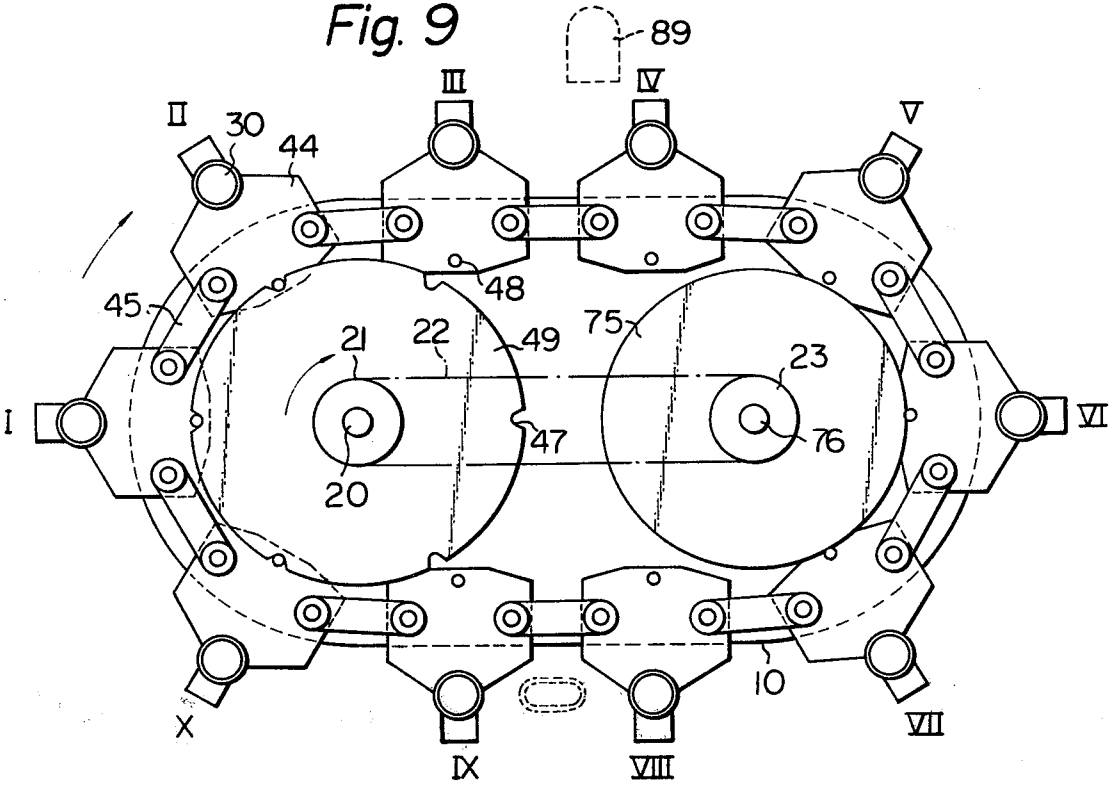
FIG. 9 is a diagrammatic side view of a toe-closing machine installed with a device of the present invention.
Figure 10:
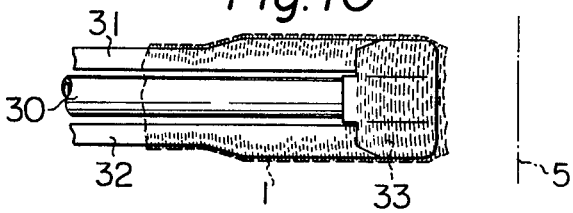
Figure 11:
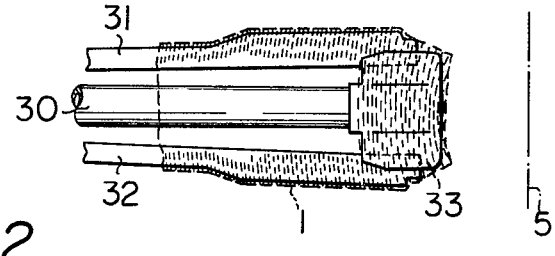
Figure 12:
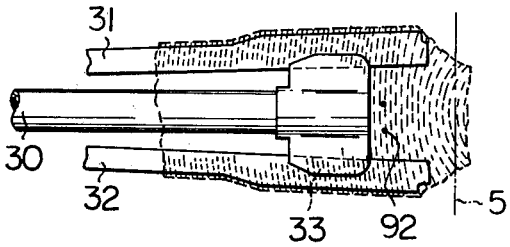
Figure 13:
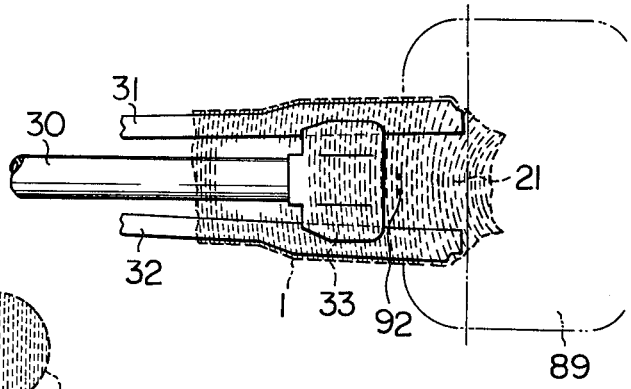
Figure 14:
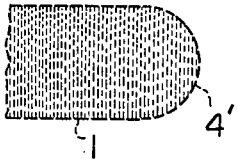
Figure 15:
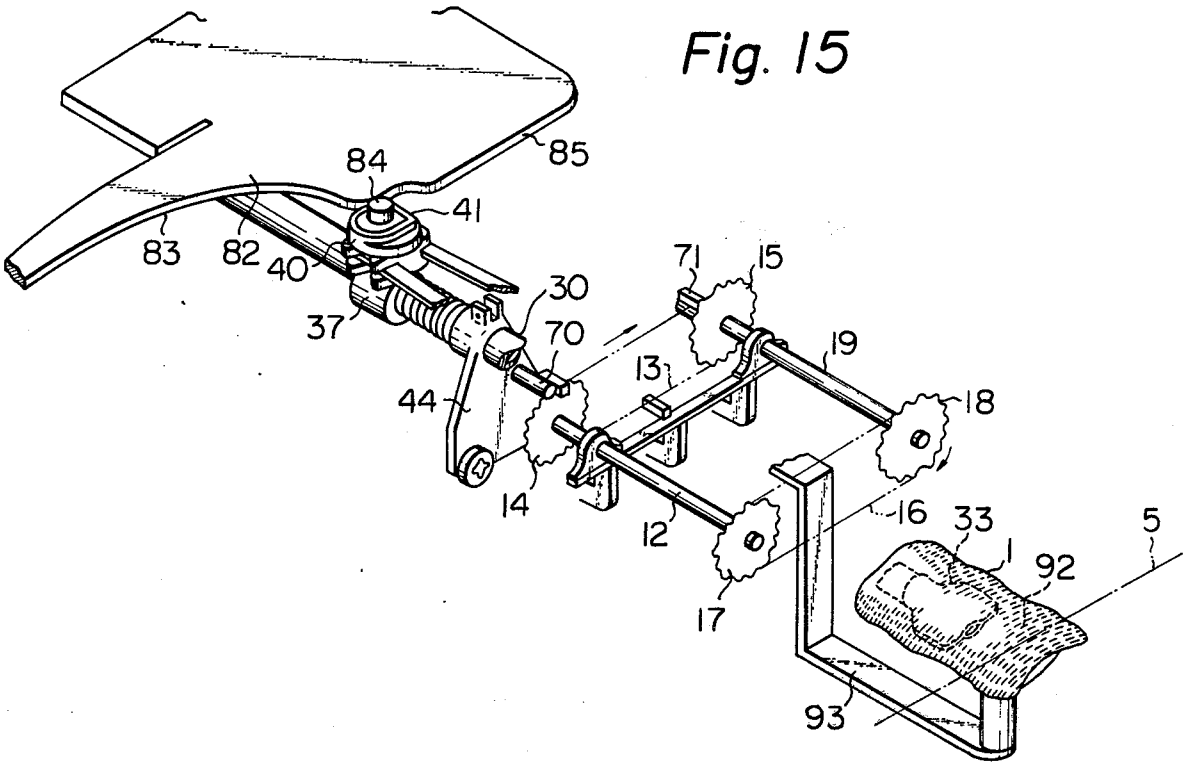
Figure 16:
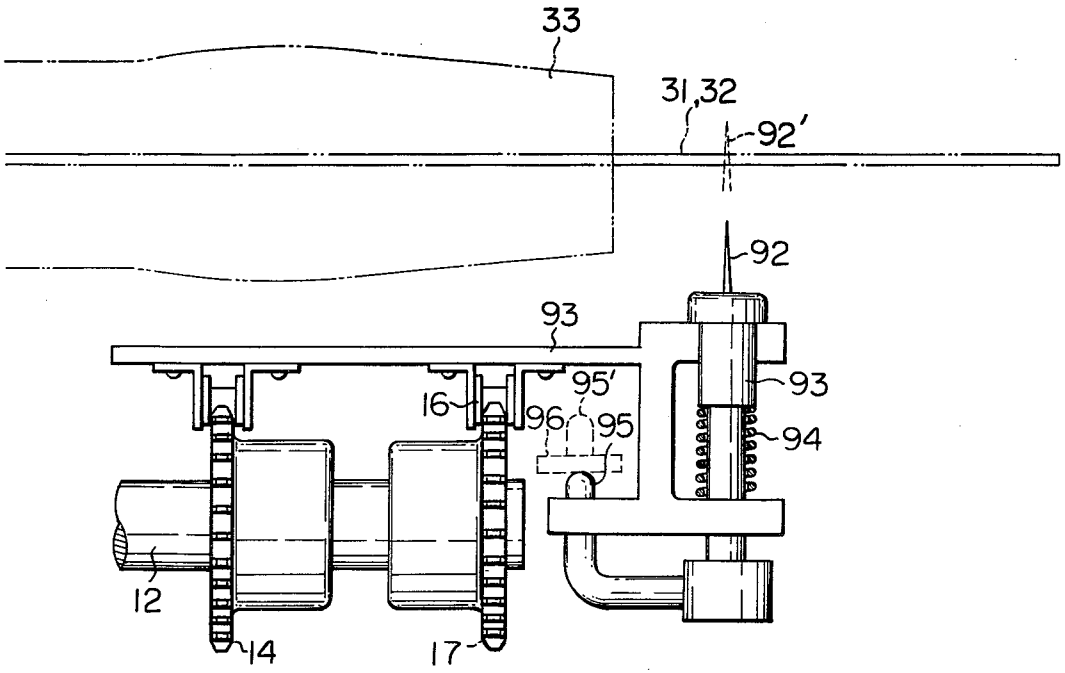
Figure 19:
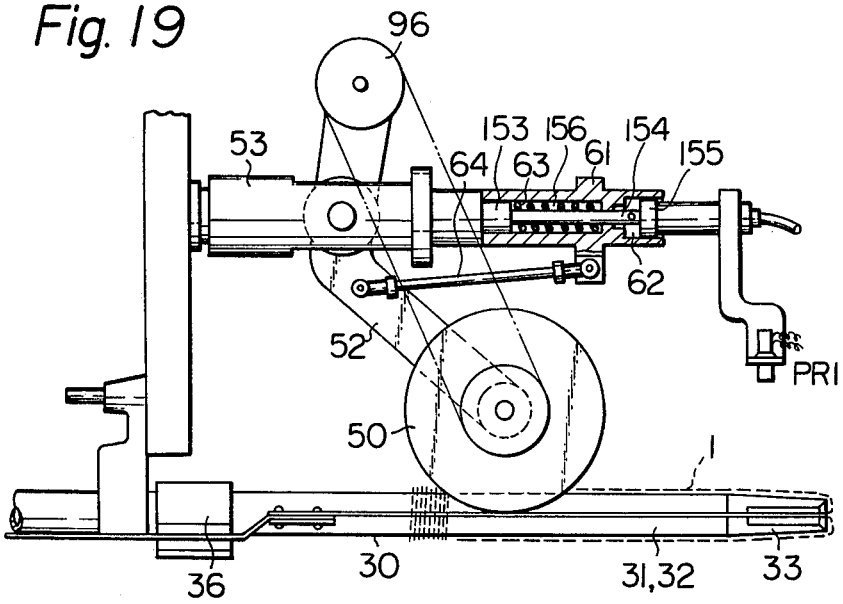
Figure 20:
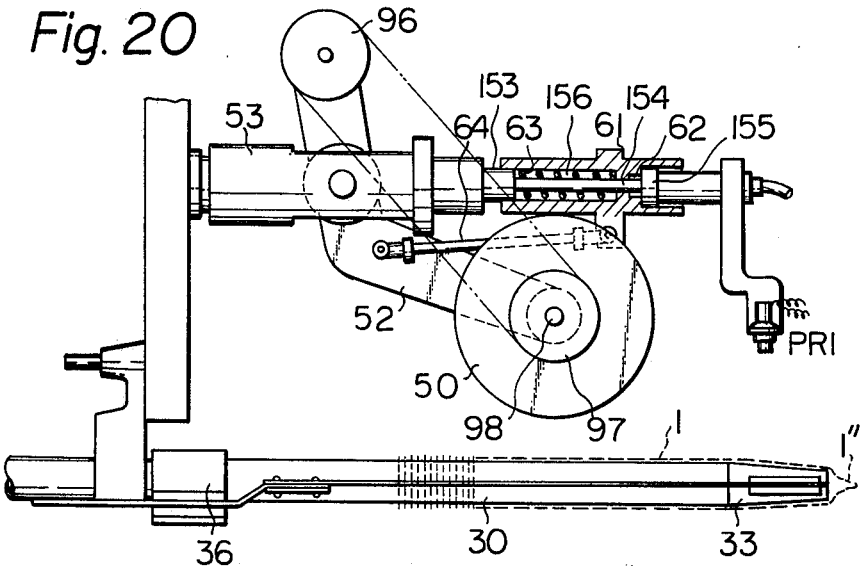
Figure 21:
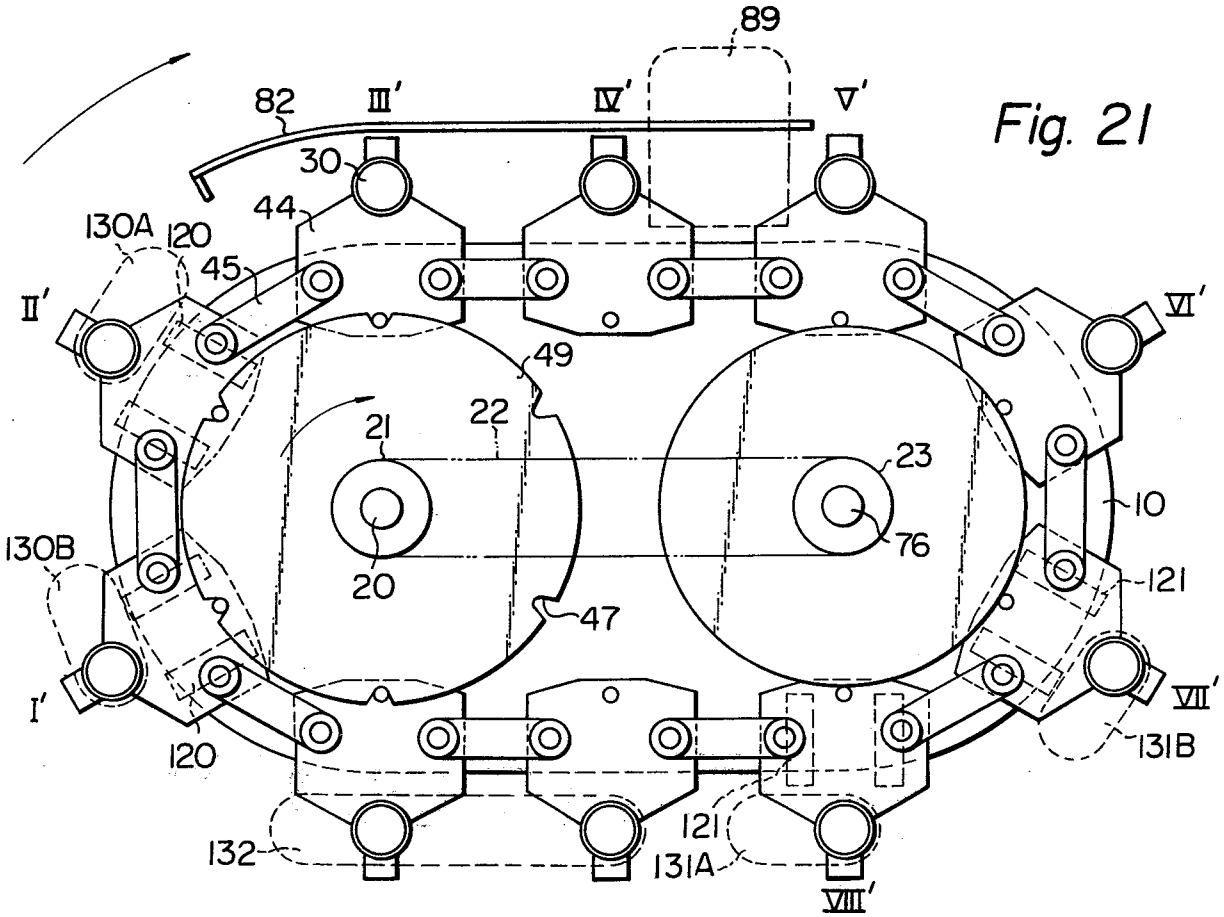
Figure 22:
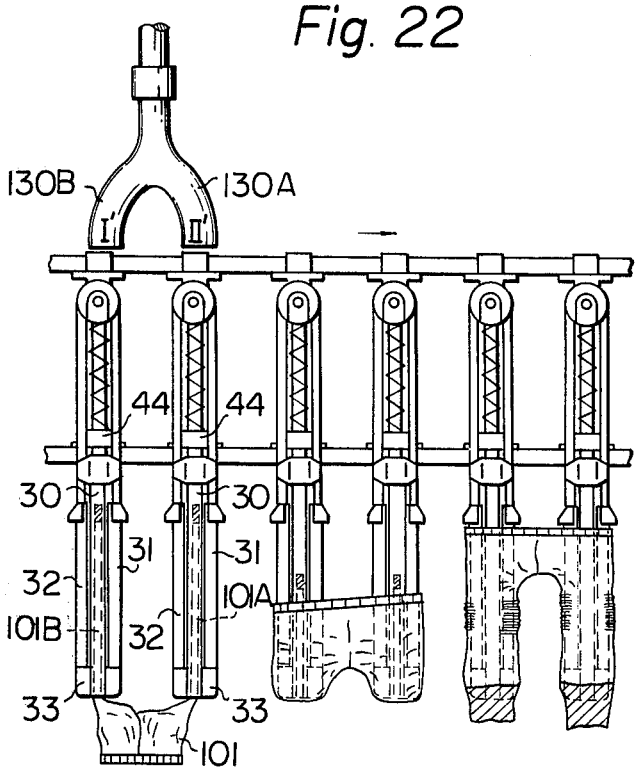
Figure 23:
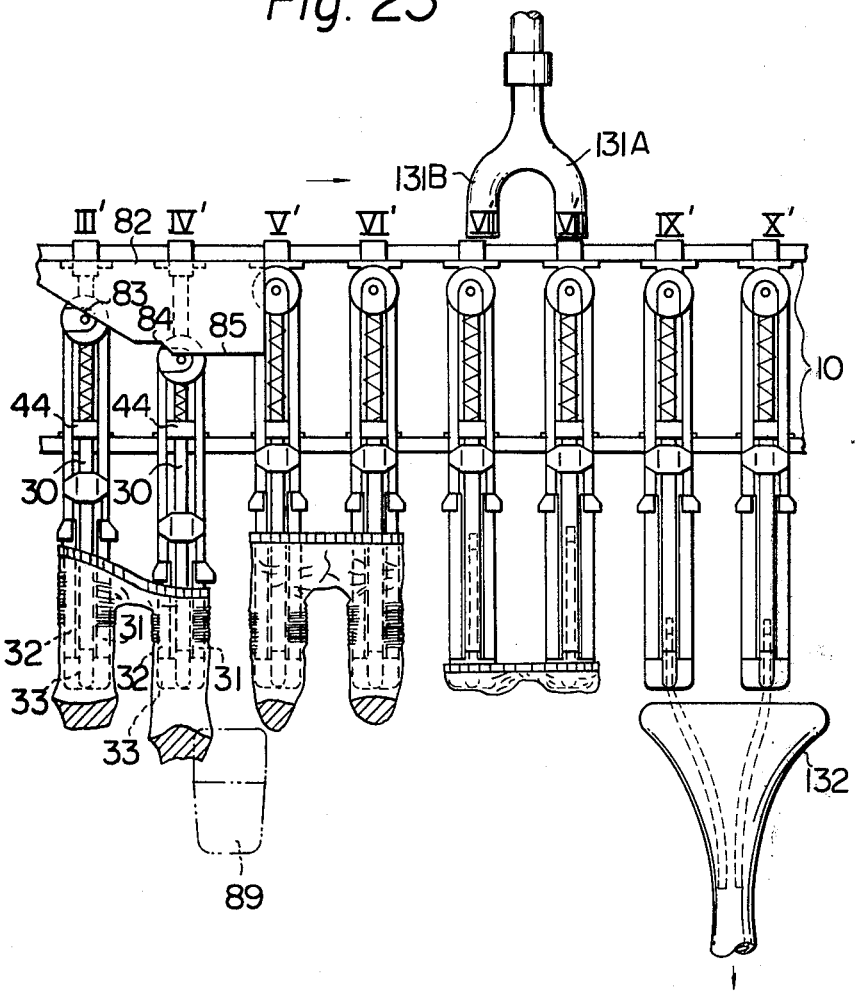

FIGS. 10 through 13 show views of a second embodiment of the device of the present invention which are similar to those of FIGS. 1 through 3, respectively, wherein, FIGS. 10 and 11 are completely the same as FIGS. 1 and 2, FIG. 12 shows the hose material being first engaged with a pin, and FIG. 13 is a view which as similar to FIG. 3;

FIG. 14 is a view similar to that of FIG. 4, which shows a hose toe-closed by means of using the second embodiment of the present invention;

FIG. 15 is a view similar to that of FIG. 6, which shows a perspective view of the second embodiment of the present invention;

FIG. 16 is a side view showing an arrangement which includes a pin device;

FIG. 17 is a plan view showing an improved holding member unit as well as a suction tube and a hose material mounted thereon, wherein the detecting device of the present invention is utilized;

FIG. 18 is a partially sectional view of the support member as shown in FIG. 17;

FIG. 19 is a side view of the drawing-on rollers when they are in operation;

FIG. 20 is a view similar to that of FIG. 19, wherein the drawing-on rollers are not in operation;

FIG. 21 is a diagrammatic side view of a toe-closing machine similar to that of FIG. 9, wherein the machine is used for manufacturing a toe-closed panty-hose;

FIG. 22 is a developmental plan of a part of the machine shown in FIG. 21, ready for the toe-closing process;

FIG. 23 is a plan view similar to that of FIG. 22, which indicates the toe-closing process and the next process for removing a pair of toe-closed panty-hose from the machine.

The toe-closer described hereinafter is similar to those described in U.S. Pat. Nos. 3,941,069 and 3,952,673 and, thus does not require detailed description. Of note, the toe-closer includes a plurality of brackets 44 which are connected by chain links 45 (FIG. 9) to move in an endless path. Each bracket 44 is associated with a holding unit (FIG. 6) in which a suction tube 30 and a pair of finger pieces 31, 32 are mounted in known manner (FIG. 5).

A hose material to be toe-closed by a device of the present invention or by a similar toe-closer is made of a knitted fabric which has a tubular form and a very low density. One end of the hose material is closed by stitching during the toe-closing operation.

For the sake of better understanding, one cycle of the toe-closing operation according to the present invention is hereinafter briefly described with respect to the parts of the toe-closing machine shown in FIGS. 22 and 23.

(a) FIRST STEP

An operator picks up a welt portion of a hose material used for making a stocking, and holds its toe end in front of a suction tube 30 (FIG. 22) so as to let the toe end of the hose be sucked into the suction tube 30. Then, the hose material is sucked into the suction tube, toe end first, while the operator holds the welt end portion of the hose material.

(b) SECOND STEP

When the hose material has been sucked into the tube 30, the above-mentioned suction is stopped. The welt portion is then manually turned inside-out and drawn over the outside of the suction tube so as to cover the suction tube 30 and, next, the hose material is automatically further drawn onto the outside of the tube by mechanical drawing-on rollers, whereby the hose material is turned inside-out. In this inside-out turning operation, the toe end portion of the hose material is brought outside of but not onto the suction tube 30.

(c) THIRD STEP

A pair of finger pieces 31, 32 covered by a hose material is spread laterally, so that the toe end portion of the hose material is deformed laterally, thereby acquiring a concavely-curved configuration at the toe end portion.

(d) FOURTH STEP

The toe end portion to be toe-closed is arranged on a stitching line of a sewing machine 89 (FIG. 23). The finger pieces 31, 32 together with the hose material are moved laterally in a straight line, so that a straight line stitch is formed on the hose material by means of the sewing machine. Further, the unused portion of the hose material is cut out by a cutter and removed from the hose material.

(e) FIFTH STEP

After completion of the toe-closing operation, the finger pieces resume their original positions. Next, the hose material is automatically drawn onto the outside of the suction tube 30 by means of drawing-on rollers so that the toe-closed hose material can be turned to its original state. Finally, the hose material is carried to the next successive working station by a suction force supplied from the suction tube, wherein the toe-closed hose material is sucked thereinto by the suction force. The present invention is mainly concerned with the above third and fourth steps.

In FIG. 1, a hose material to be toe-closed by a device of the present invention or by a similar toe-closer, consists of a leg which is turned inside-out to cover a suction tube 30 as well as finger pieces 31, 32 shown in FIGS. 5 (A, B, C). The toe end portion of the hose material to be toe-closed is arranged such that this portion is situated outside the outer ends of finger pieces 31, 32.

When the finger pieces 31 and 32 are opened as shown in FIG. 2, the hose material is spread out laterally; thus, the toe part is deformed as shown in FIG. 2.

Keeping this condition, the finger pieces 31, 32 are displaced horizontally toward the direction of the toe portion along the extended axis line of the suction tube 30, until the displacement between the finger pieces 31, 32 and the suction tube 30 reaches a position as shown in FIG. 3. In this case, as the toe part of the hose material is displaced to a position far from the outer-end of the support member 33 of the suction tube 30, the middle part of the hose material is thereby stretched to a condition such that it can contract freely by itself. Consequently, the toe part is then deformed into a concavely-curved configuration because it is returned from its stretched condition to the original one due to the hose material being of a fabric with a very high elasticity and of a good resilience. The thus deformed toe portion of the hose material has a configuration as shown in FIG. 3. By arranging the toe portion to be toe-closed on the stitching line of a stationarily-disposed sewing machine and stitching the toe portion in a straight line together with moving the hose material in a lateral direction, a straight-line stitching is thereby formed on the hose material.

When the hose material is freed from being held by means of the holding member unit, a toe-closed edge homing a curved line of a small radius, as shown in FIG. 4, can be obtained, due to the good elasticity of the hose material, thus creating the toe-closed line 4 in FIG. 4 and causing the cut edge to have a curve similar to that of the toe-closed edge.

Figure 5A:
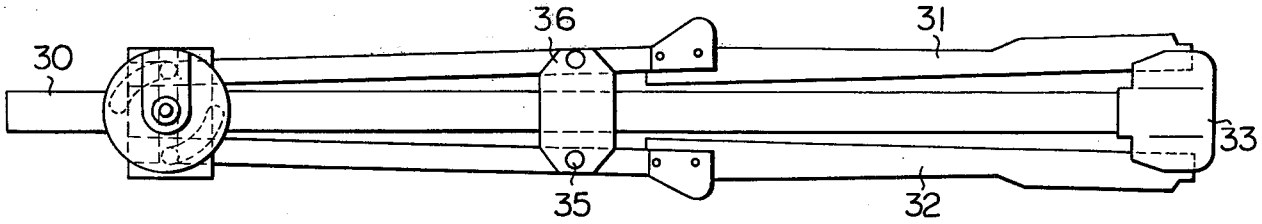
FIG. 5A shows the finger pieces being spread laterally.
Figure 5B:
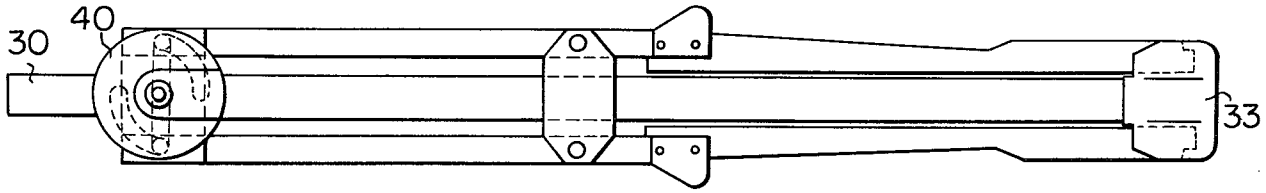
FIG. 5B shows the finger pieces being closed.
Figure 5C:
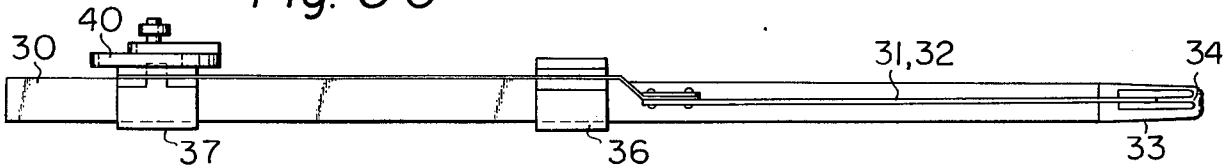
FIG. 5C shows the side view of the holding member unit and the suction tube.

Referring to FIGS. 5*a*, 5*b*, 5*c*, each holding member unit has a support member 33 fixedly mounted at the outer end of the suction tube 30. The support member 33 is provided with two guide slits 34 arranged symmetrically while, in FIG. 5C, a front sliding member 36 and a back sliding member 37 are mounted slidably on the suction tube 30. A pair of finger pieces 31, 32 is pivotally mounted on both sides of the front sliding member 36 by means of pins 35 (FIG. 5A), while the front part of each piece is slidably engaged with the two guide slits 34 of the support member 33. A circular plate 40 is mounted on the back sliding member 37, which acts to induce a relative displacement, i.e., to open or close the front parts of the pieces 31 and 32 by the turning movement of the plate 40. Consequently, after the plate 40 has been turned a quarter of a turn, the front parts of the pieces 31 and 32 are displaced as shown in FIG. 5A (i.e., in an open condition). When the plate 40 is turned in the reverse direction, then the front parts of the finger pieces 31 and 32 are restored to their original position as shown in FIG. 5B. Since the pair of finger pieces 31 and 32, the front sliding member 36, and the back sliding member 37 are so constructed in one holding member unit, the entire unit is displaceable along the extended longitudinal axis line of the suction tube 30.

However, in FIG. 5A, the outer end of each of the finger pieces (31 or 32) has a stepped configuration. However, the ends should never be restricted to such a stepped configuration. Both ends may have other configurations as long as a concavely-deformed curve of a desired radius can be obtained in the deformed hose material.

Figure 7:
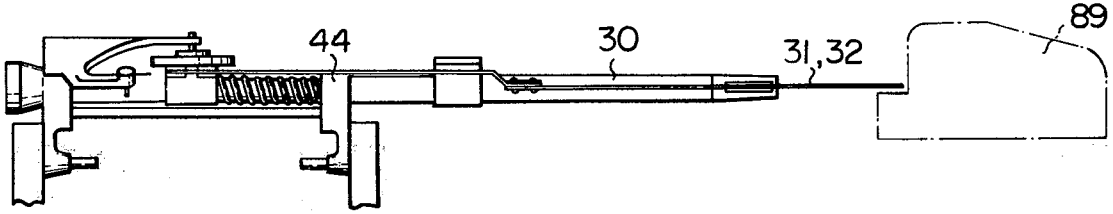
FIG. 7 is a side view of the device as shown in FIG. 6.
Figure 8:
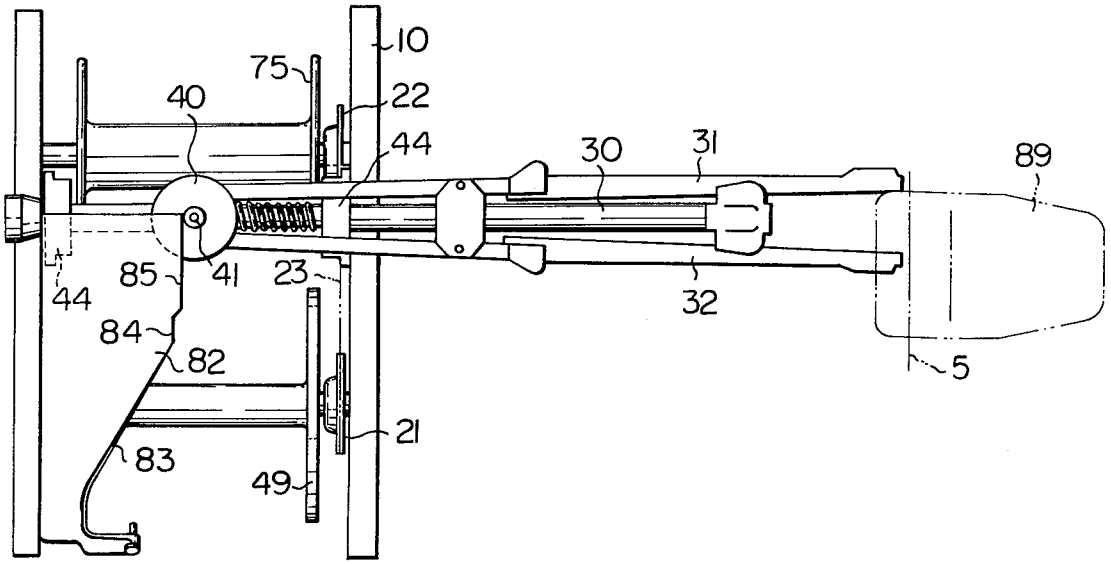
FIG. 8 is a plan view of the device as shown in FIG. 6.

One embodiment for carrying out the above-described steps of the method of the present invention is shown in FIGS. 6 through 8.

In FIGS. 6 through 8, each suction tube 30 is fixedly mounted on a bracket 44 which travels along a frame 10 of the toe-closer, wherein the center line of the suction tube 30 is perpendicular to the travelling direction of the bracket 44 along the frame 10. This bracket 44 is arranged at the middle of the suction tube 30 between the front sliding member 36 and the back sliding member 37 (as shown in FIG. 5C). A spring 81 is located between the bracket 44 and the back sliding member 37. On the back sliding member 37, a cam roller 41 is rotatably mounted, while a cam plate 82, provided with three cam surfaces 83, 84 and 85 which come into contact with the cam roller 41, is fixedly mounted on the frame 10 of the toe-closer.

According to the traversing of the bracket 44 toward the right direction in FIG. 6, firstly, the cam roller 41 comes into contact with the cam surface 83, and the cam surface 83 acts to push the holding member unit forward along the suction tube 30 overcoming a force of the spring 81. When the cam roller 41 comes into contact with the cam surfaces 84 and 85 the unit and the suction tube 30 are displaced to a position as shown in FIG. 3. Consequently, the cam roller 41 is maintained in contact with the cam surface 85 for as long as it takes for the toe portion of the hose material to be toe-closed and stitched completely along a straight line by a stationarily disposed sewing machine.

Referring to FIG. 9, ten separate brackets 44 are distributed along an oval passage on the frame 10. A main driving shaft 20 and a follower shaft 76 are rotatably mounted on the frame 10 at both centers of the oval passage, respectively. On the main driving shaft 20, a driving drum 49 is fixedly mounted, while on the follower shaft 76, a follower guide drum 75 is also fixedly mounted, for pushing or guiding the brackets 44. By a driving chain wheel 21 mounted on the main driving shaft 20 and a follower chain wheel 23 mounted on the follower shaft 76, the turning motion of the main driving shaft 20 is transmitted to the follower shaft 76 via an endless chain 22.

The driving drum 49 has a plurality of dented grooves located along its peripheral surface. Each bracket 44 also has a projection 48, which is engageable within the dented groove 47 such that the bracket 44 can be pushed by the driving drum 49. Consequently, in the case as shown in FIG. 9, three brackets are pushed so that they travel along the oval passage when the drum rotates together with the main driving shaft 20 maintaining the engagement of the three projections 48 with the three dented grooves 47, respectively. In FIG. 9, each of the ten symbols of I, II, III, IV, V, VI, VII, VIII, IX and X, represents a specified position of one of the brackets 44.

When one of the brackets 44 is being moved from position I to position II, the operator picks up the welt portion of the hose material and holds the toe end in front of the suction tube 30 of the holding unit. Then, the hose material is sucked into the suction tube 30 by a pneumatic force. After stopping the pneumatic force, the welt portion of the material is placed over the free end portion of the support member 33 (FIG. 5A) on the suction tube 30. Some of the material not yet covering the support member is automatically drawn over the outside of the suction tube 30; thus, the hose material is turned inside-out. In this case, it is necessary to keep the toe part of the hose material outside of the respective support member.

When one of the brackets 44 is being moved from position II to position III, a pair of finger pieces 31 and 32 (FIG. 5A) is separated, so that the toe part of the material, into which the pair of finger pieces is inserted, is spread out laterally. Then, the finger pieces together with the hose material are advanced toward a sewing machine 89.

When one of the brackets 44 is being moved from position III to position IV, the finger pieces 31 and 32 are further advanced toward the sewing machine 89, until the line on the toe part of the material to be stitched thereon enters into the stitching position of the sewing machine 89. By laterally traversing the finger pieces 31 and 32 together with the material as well as by carrying out the operation of the sewing machine, a stitched line 5, as shown in FIG. 3, is formed on the toe part, and a cut edge is also formed.

When one of the brackets 44 is being moved from the position IV to the position V, the finger pieces 31 and 32 are moved far from the sewing machine. Also, these finger pieces 31 and 32 are retracted into a support member 33 of the suction tube 30 as shown in FIG. 5B. Then, similar to the conventional toe-closer and as not shown in Figures, when one of the brackets 44 is being moved from the position V to the position VI, the welt portion of the hose material is drawn into the suction tube 30.

When one of the brackets 44 is being moved from the position VI to the position VII, the toe of the toe-closed hose material is first sucked into the suction tube 30 by a pneumatic force, and then a part of the toe-closed hose material remaining on the holding device is sucked into the suction tube 30, so that it is turned from inside-out and back to its original side.

When one of the brackets 44 is being moved from the position VII to the position IX, the toe-closed hose material with its original side is pneumatically transported to the downstream working station.

When one of the brackets 44 is being moved from the position IX to the original starting position I, no action is taking place. Thus one entire cycle of the toe-closing operation according to the present invention is finally completed when the bracket 44 has returned to position I.

As disclosed above, a rotatable clamping device of a special type of sewing machine, which clamps the toe part of the hose material from above and below and which is indispensable to a conventional toe-closer can be dispensed with in the method and the apparatus of the toe-closer for carrying out the present invention. Therefore, in the toe-closer of this invention, a stationarily disposed conventional sewing machine can be employed, and furthermore, the machine is sufficient for laterally moving the toe part to be toe-closed along a straight line. This means that the toe-closing operation can be carried out with much simplicity, steadiness, and high speed.

By using the above-mentioned method and apparatus, a toe-closed hose material with a toe-closed line 4 (FIG. 4) of a radius of 100 to 150 mm can be manufactured. If the radius is required to be as small as 50 to 80 mm, then a hose material with a toe-closed line of such a small radius can be manufactured by using a pin device. By using this pin device, the hose material can be deformed even more by using the above-mentioned toe-closing process.

FIGS. 10 through 13 show four positions of the holding device and the hose material when a pin device is used. One of the differences existing between FIG. 3 and FIGS. 12 and 13 is the fact that two pins 92 are engaged to the hose material 1 at the center thereof when the hose material 1 is projecting largely from the outer end of the support member 33 disposed on the suction tube 30 and also from the outer ends of finger pieces 31 and 32. However, there is no restriction on the number of pins that can be used. FIG. 13 shows an arrangement wherein the finger pieces have been moved more forward than the arrangement shown in FIG. 12. However, the positional relationship between the pins 92 and the support member 33 is retained without any changes.

Between the frame and a sewing machine, as shown in FIG. 15, a chain driving shaft 12, with front and back chain wheels 14 and 17 is rotatably mounted on the frame (not shown). It is preferable that, such shaft 12 be arranged to coincide with a line passing through the middle point on the cam surface 84 of the cam plate 82. Another follower shaft 19 with front and back chain wheels 15 and 18 which are provided with the same number of teeth as those of the chain wheels 14 and 17, respectively, is rotatably mounted on the frame 10, wherein the center line of the shaft 19 lies on a vertical plane containing the side edge of the cam surface 85 or slightly in front of the cam surface 85. Over such pairs of chain wheels 14 and 15 and also 17 and 18, endless chains 13 and 16 are engaged, respectively.

On the endless chain 13, a plurality of equally spaced driven members 71 is mounted, while one driving projection 70 is projected from the bracket 44, so that the projection 70 pushes the driven member 71. Consequently, according to the traversing of the bracket 44, the driven member 71 on the chain 13 moves at the same speed and also toward the same direction as the speed and direction of the bracket 44.

On the endless chain 16, the same number of equally spaced pin holders 93 as the number of driven members 71, are mounted as shown in FIG. 16. Hose guiding pins 92 having sharp points are held vertically on the pin holder 93 as shown in FIG. 16, wherein the top of the pins 92 are directed vertically and outwardly within the plane of the endless chain 16, and the pins 92 are held slidably within the hole of the pin holder 93, which is mounted on chain 16.

The normal position of the pins 92 against the holder 93 is maintained by arranging a spring 94 between them, so that the length of the portion of the pins 92 projecting from the holder remains constant, otherwise the pins 92 can be pushed down by other members. As shown in FIG. 16, the pin holder 93 is provided with a stop 95. When the stop 95 comes into contact with a stationarily arranged guide plate 96, the pin 92 will then take the position as indicated by the solid lines A in FIG. 16. However, when the stop 95 is out of contact with the guide plate 96, as shown by 95', the pin 92 will then take the position 92' indicated by the broken lines B in FIG. 16, whereby the sharp point of the pin 92 passes through the plane of the finger pieces 31, 32 to pierce through and engage with the hose material 1.

By the above method, a toe-closed line 4' as shown in FIG. 14 can be obtained.

The above description relates to a method for manufacturing a toe-closed seamless hose. However, the device can also be well applied to the process of toe-closing a hose material for the manufacturing of toe-closed panty hose stockings.

In FIGS. 22 and 23, a panty hose material 101 consists of two pieces of hose or leg portions 101A, 101B, which are united into one piece of panty hose material. Consequently, the panty hose material must be simultaneously mounted onto two adjacent suction tubes 30 in such a manner that, when two adjacent brackets 44 are being moved from position II' to position III' or from position I' to position II', respectively, the operator must pick up the united portion of the panty hose material and hold the toe ends in front of the respective suction tubes 30. Then, the legs 101A, 101B of the panty hose material 101 are sucked into the two adjacent suction tubes 30, respectively, by a pneumatic force supplied into the suction tubes 130A, 130B, as shown in FIG. 22. After stopping the pneumatic force, the united portion of the material is placed over both adjacent free end portions of the support members 33 of the adjacent suction tubes 30. A part of the material not yet covering the support members is automatically drawn over the outside of the suction tubes 30 by means of two pairs of drawing-in rollers 120 (in FIG. 21). Thus, the two legs 101A, 101B of the panty hose material are turned inside-out. In this case, it is necessary to keep the toe portions of the panty hose material from being placed on the support members.

When one of the brackets 44 is being moved from position II' to position III' in FIGS. 22 and 23, while another one of the brackets 44 is being moved from position I' to position II', a pair of finger pieces 31 and 32 of the first bracket is separated, so that the toe part of the material, into which the pair of finger pieces is inserted, is spread out laterally. Then, the finger pieces together with the legs 101A of the panty hose material 101 are advanced toward a sewing machine 89 as shown in FIG. 23. When the second bracket of the adjacent two brackets 44 is being moved from portion I' to portion II' and the first bracket is being moved from portion II' to portion III', there is no separating of the pair of finger pieces 31 and 32 of the second bracket 44.

Consequently, leg 101A is followed by leg 101B after a time delay and with the same operational condition prevailing; therefore, only the operational sequence for leg 101A is explained hereinafter.

When the first bracket 44 is being moved from position III' to position IV' in FIG. 23, the finger pieces 31 and 32 are further advanced toward the sewing machine 89, until the line on the toe part of leg 101A of the material 101 to be stitched thereon enters into the stitching position of the sewing machine 89. By laterally moving the finger pieces 31 and 32 together with the leg 101A as well as by carrying out the operation of the sewing machine, a stitched line 5 as shown in FIG. 3 is formed in the toe part of the leg 101A, and a cut edge is also formed on the toe part of the leg 101A.

When the first bracket 44 is being moved from the position IV' to the position V', the finger pieces 31 and 32 are moved far from the sewing machine and are also retracted into the suction tube 30.

When the first and second brackets pass through the positions VII' and VIII' in FIG. 23, respectively, the toes of the legs 101A, 101B of the toe-closed panty hose are sucked into the suction tubes 30, respectively, by a pneumatic force supplied into suction tubes 131A and 131B as shown in FIG. 21. Then, some parts of the legs 101A, 101B remaining on the support members are sucked into the suction tubes 30, so that these parts are turned from inside-out and back to their original sides by means of two pairs of drawing-in rollers 121.

When the first and second brackets pass through the positions IX' and X' in FIG. 23, respectively, the toe-closed legs 101A, 101B with their correct sides out are simultaneously removed from the suction tubes 30, so that the toe-closed panty hose material 101 can be pneumatically transported to the downstream working station by means of the suction device 132.

If both legs 101A, 101B of the panty hose material 101 are to be toe-closed in the same fashion, in such a case, then an arrangement of two of the adjacent suction tubes mounted on one bracket can be used.

Any of the toe-closing machines using either one of the two embodiments of the present invention can obtain a high rate of production as mentioned above. In such a toe-closing machine, as all of the holding member units and suction tubes travel continuously along an oval passage at the same speed, it may take only two seconds, for example, for one of said holding member units together with a suction tube to move from position I to position II. Therefore, within this two-second interval, the operator must place the welt portion of the material over the free end portion of the support member, and thereafter, the material is automatically drawn over the suction tube by means of the drawing-on rollers. In this case, the toe part of the hose material must be kept outside of the support member. If such condition is not realized, then the operator must pull back the toe part up to its required position. Actually, when such a pulling-back operation is required, it is impossible to carry out the total operation within the above-mentioned two-second interval. To obviate this disadvantageous condition, an automatic device such as a detector, which acts to position a hose material correctly on a support member, can be effectively used. By applying such an automatic device to toe-closing machines, a high rate of production can be guaranteed.

The correct positioning of the hose material on a support member involves a second step as described hereinbelow.

In this second step, a hose material 1 is completely turned inside-out after being wound on the suction tube 30 by means of drawing-on rollers. During when this winding-on operation is being carried out, such hose material is moved from the inside of the suction tube toward the outside of the suction tube by turning over the front edge of the support member 33 of the suction tube 30. This turning movement of the hose material over the front edge of the support member 33 can generate a high friction between the hose material and the support member 33. Consequently, the hose material 1 extending between the portion receiving a winding-on operation by means of the drawing-on rollers and the portion disposed directly on the support member 33 is greatly stretched, thereby causing the hose material 1 to be extended into an abnormally elongated hose material. After completion of the winding-on operation, the portion of the hose material which was delivered from the inside of the suction tube 30, is pulled quickly toward the portion nearest the drawing-on rollers assisted by the resilience of the hose material. This means that no portion of the hose material 1 can be retained on the support member 33, as long as the resilient force is stronger than the frictional force.

As disclosed before in the second step of the present invention, the toe end portion of the hose material must be brought outside of but not onto the suction tube. To obtain this condition, it is necessary to manually pull back the end of the hose material 1 up to a predetermined position. If a photoelectrical detecting means intended for stopping the winding-on operation is used for detecting the rear edge of the hose material 1 moving over the outer end of the support member 33, then it becomes almost impossible to stop the movement of the hose material in such a way that the rear end of the hose material is left to remain outside of the support member, because the winding-on speed of the hose material 1 is higher than the speed by which the rear end of the hose material can be stopped at a given position on the support member 33.

To obviate the above-mentioned drawback and to satisfy the above-mentioned required condition, the rear edge of the hose material 1, which is left remaining within the suction tube 30 and which has a proper length extending from the fron edge of the support member 33, is detected by a detector disposed outside of the support member 33 according to the method of the present invention.

Because a portion of the hose material 1 being wound on the suction tube 30 is also covering the outside of the suction tube 30 as well as the support member 33, a beam produced by this photoelectrical means can be passed through the hose material 1 turned inside-out and can also enter the portion of the hose material 1 for detecting the portion 1' disposed inside the suction tube as shown in FIG. 18. As the hose material is quite low in density, the hose material allows the beam to pass therethrough.

As there is a short time duration before the detected end reaches almost near the top of the support member 33, consequently, if the operation of the drawing-on rollers acts to stop the winding-on operation with a proper time delay from the time the rear end of the hose material 1 within the suction tube 30 is detected by the detecting means, it is then possible to stop the end of the hose material 1 under the desired condition as mentioned in the second step above. This means that the necessity of using any manual operation for accomplishing this purpose can be completely eliminated.

It is preferable that the time duration be controlled to the most suitable time duration.

In the drawing-roller device as shown in FIGS. 19 and 20, a stepped portion 153 and a shaft 154 are provided on the outer end of the extended boss of the angular displacing arm 53. A sliding block 61 is slidably mounted on both the stepped portion 153 and the shaft 154. At the outer end of the shaft 154 a piston 155 is fixedly mounted. At one end of the sliding block 61 an inner cylindrical surface, within which the piston 155 moves, is provided so that cavity 62 is defined by said surface and the piston 155, while at the opposite end of the sliding block 61 a cylindrical cavity 156, within which a spring 63 is housed, is formed. By the arrangement of the spring 63 between the outer end of the stepped portion 153 of the boss of the angular displacing arm 53 and the upper surface of the cylindrical cavity 156, the sliding block 61 is moved so that the sliding block 61 is separated from the bottom stepped surface of the stepped portion 153. When compressed air is inserted into the cylinder area after passing through an inlet hole (not shown) provided on the piston 155, the compressed air acts to push back the sliding block 61 against the spring force of the spring 63, so that the sliding block 61 comes into contact with the bottom stepped surface of the stepped portion 153 of the boss of the angular displacing arm 53, as shown in FIG. 19.

Referring to FIGS. 19 and 20, a connecting rod 64 is arranged between the arm of the swing arm 52 and the projection of the sliding block 61, and the two ends of the connecting rod 64 are pivotally mounted by pins on the swing arm 52 and the sliding block 61. By this arrangement, when the sliding block 61 is pushed back by the compressed air, the first drawing-on rollers 50 are moved downwardly in the drawing, so that the surfaces of the rollers 50 come into contact with the upper surfaces of the finger pieces 31 and 32, respectively. When the sliding block 61 is pushed by the spring 63, the first drawing-on rollers 50 are lifted so that the first drawing-on rollers 50 are freed from contact with the surface of the finger pieces 31 and 32. In some cases, a photoelectric inspector PR1 mounted on said piston 155 is provided, so that it can detect the existence of the rear end 1' of the hose material 1 within the inside of the suction tube 30 as shown in FIG. 18. The operation of the PR1 is described later in this specification.

As mentioned above, after the drawing-on rollers 50 have come into contact with the surface of the finger pieces 31 and 32 caused by compressed air being inserted into the cavity 62, and after a portion of the hose material already turned inside-out has been clamped by means of the rollers 50 and the finger pieces 31 and 32, the portion of the hose material turned inside-out is then progressively wound on the suction tube 30 by the rotation of the rollers 50.

As shown in FIG. 18, a lateral opening 133 is provided on the support member 33 of the suction tube 30. And, as shown in FIGS. 19 and 20, a photocell-type detecting device PR1 is arranged on a center line passing through the opening 133 (FIG. 18), and mounted on the piston 155.

After the first step has been carried out as described hereinbefore, a portion of the hose material 1 which is turned inside-out must be handled by the operator to cover the suction tube 30. In this case, another portion 1' as shown in FIG. 18, which has not yet been turned inside-out must be made available inside the suction tube 30. Consequently, when the photocell-type detector PR1 is in operation, the light beam emerging from the detector PR1 first passes through a thin fabric of the hose material 1 disposed on the support member 33, and then enters into the portion 1' of the hose material, which is disposed inside of the suction tube 30, after passing through the opening 133 provided on the support member 33. Similarly, the deflected light beam coming from the surface of the portion 1' of the hose material 1 again passes through the opening 133 as well as th hose material 1 disposed on the support member 33, and finally enters into the photocell-type detecting device PR1. Thus, the detector PR1 can detect the existence of the portion 1' of the hose material within the suction tube 30. When the detector PR1 has detected the moving of end 1" of the hose material from the center line of the opening 133, the detector PR1 will then provide a signal indicating the occurrence of such a condition. This signal can be used to separate the rollers 50 from the finger pieces 31 and 32, thereby stopping the winding-on operation of the hose material 1 onto the suction tube 30.

However, there is a tendency for the hose material to continue moving on the surface of the suction tube 30 at the same time the winding-on rollers 50 are separating from the finger pieces 31 and 32. Consequently, after the portion of the hose material 1 immediately disposed between the rollers 50 and the finger pieces 31, 32 has completely stopped moving, there is a tendency for the portion of the hose material 1 on the support member 33 to be pulled toward the rollers by contraction of the hose material extending between the above-mentioned two portions of the hose material, because the high elasticity of the hose material. During the winding of the hose material onto the suction tube 30, a portion of the hose material extending between the above-mentioned two portions of the hose material is always in a stretched condition, due to the occurrence of a high frictional resistance between the hose material and the outer surface of the support member 33.

Consequently, if the opening 133 and the detector PR1 are positioned almost at the end of the support member 33, even when the rollers 50 are separated from the finger pieces 31 and 32 by the signal resulting from detection by said detector PR1, it would be impossible to stop the end 1'' of the hose material 1. In which case, the end 1'' would continue moving until it reached a position nearest the rollers 50. If such a stopped condition does occur, then a disadvantage may arise, whereby an additional operation may be necessary to drawback the end 1'' to the given position by hand, at which position the end 1'' is disposed outside the end of support member 33.

To eliminate such a disadvantage as mentioned above, in the present invention, the opening 133 and the detector PR1 are arranged on the center line, which is situated at a suitable distance from the outer end of the support member 33. By selecting a suitable distance and also by controlling the time delay occurring between the time of the above-mentioned detection and the time of the separation of the rollers 50 from the finger pieces 31, 32, the end 1'' of the hose material 1 will stop at a position situated outside of the support member 33 as shown in FIG. 2. This means that for this case no manual operation is necessary.

Actually, the modern high-speed toe-closer can toe-close a hose material within an interval of two seconds or less. If a manual operation were necessary, the required time for toe-closing a hose material would probably range far above two seconds. By using the device of the present invention for such a high-speed toe-closing operation, the time required to toe-close a hose material can be considerably shortened. However, such high-speed production can be guaranteed only when the detecting device of the present invention is employed for the toe-closing operation.

As another embodiment of the improved support member mounted on a suction tube 30, the support member (not shown) can be made of transparent plastic. In this case, an opening 133 provided on the support member 33, as shown in FIG. 18, is not necessary, because any portion of the support member can allow a light beam to pass through the wall thereof.

It is preferable to adjust a setting position of the detector PR1 with respect to the support member. Therefore, the necessity of a time delay, which is necessary when using the support member 33, can be dispensed with.

What is claimed is:

1. A method of automatically closing each toe of a plurality of hose materials successively by a straight line stitching wherein said materials are held on a plurality of pairs of parallel and horizontal holding member units together with suction tubes including support members and finger pieces continuously travelling in a lateral direction and wherein a sewing machine is disposed stationarily at one portion within said lateral travelling passage, so that the toe-closing operation is accomplished while said holding member units, said support members and said suction tubes are continuously travelling in a lateral direction, the method characterized by the steps of:

arranging an end of said hose material turned inside-out at a position outside the outer end of said holding member and finger pieces, wherein said hose material covers said holding member and said finger pieces;

laterally spreading said hose material by a pair of said finger pieces extending from within said support members which are inserted within said material, so as to deform said hose material into a concaved configuration at the edge of the toe end portion of said hose material;

bringing said hose material together with said finger pieces to a stitching line of said sewing machine while said hose material is maintaining its laterally-spread condition;

stitching the thus deformed toe part along a straight line perpendicular to the center line of said material so as to form said straight line stitching on said toe part to be closed, and at the same time cutting said toe part along a cutting line parallel to said stitching line, for forming a cut edge;

restoring said deformed toe part to its original undeformed state, and;

freeing the toe-closed hose material from the holding action of said pair of finger pieces caused by retracting said finger pieces into said support member.

2. A method as claimed in claim 1, further characterized by the step of:

detecting the end of said hose material disposed within said suction tube in such a way that said detecting operation can be carried out by inspecting through said hose material arranged in said holding member to determine whether the length of said hose material has a predetermined length within said holding member.

3. An apparatus for closing a toe portion of a hose material, comprising:

a sewing machine disposed stationarily;

a plurality of holding member units and suction tubes which travel laterally to the front of said sewing machine, each of said holding member units and said suction tubes holding one hose material to be toe-closed;

a pair of finger pieces mounted on each of said holding member units, spreading means for said finger pieces, whereby the free ends of said finger pieces can be spread out laterally, and;

a laterally moving device for moving said holding member units together with said finger pieces and said suction tubes in a lateral direction with respect to said sewing machine when the front edges of said finger pieces together with said hose material enter into the stitching line of said sewing machine and pass through the stitching zone of said sewing machine.

4. An apparatus as claimed in claim 3, further comprising, a pin device moving synchronously along with said holding member unit in a parallel direction, said pin device projecting above said hose material, so that said material can be fixedly supported by said pin device, and that said material together with said pair of finger pieces can then be advanced from said pin device.

5. An apparatus as claimed in claim 3, further comprising an endless chain which holds said pin device thereon and travels along an oval passage provided on a frame.

6. An apparatus as claimed in claim 5, wherein said sewing machine is disposed midway along one side of a straight passage of said oval passage, along which said holding member unit is travelling so that said sewing machine can stitch to close said toe on said hose material.

7. An apparatus as claimed in claim 3, wherein the two sets of adjacent holding member units and suction tubes, are arranged in such a way that two pieces of said hose material forming one united panty hose can be respectively mounted on said two sets of adjacent holding member units together with said two suction tubes.

8. An apparatus as claimed in claim 7, wherein said two sets of adjacent holding member units together with said two suction tubes are mounted on a bracket in a parallel arrangement.

9. An apparatus as claimed in claim 4, further comprising;

rollers for winding on said hose material;

an opening provided on said support member at a distance from the outer end thereof;

a photoelectrical detector arranged on a line passing through said opening, so that a signal emitted at said detector can be used for stopping the operation of said rollers.

10. An apparatus as claimed in claim 9 wherein said support member is made of a transparent material, through which a light beam passes;

a photoelectrical detector disposed at a position spaced at a distance from the outer end of said support member, so that a signal emitted at said detector can be used for stopping the operation of said winding on rollers.

11. An apparatus as claimed in claim 9, further comprising a control device for causing a time delay between the time at which said photoelectric detector detects said end of said hose material and the time at which said winding-on rollers separate from the surface of said finger pieces.

12. An apparatus as claimed in claim 10, further comprising said photoelectrical detector being adjustably disposed along said holding member.

13. In an apparatus for automatically closing the toe of a hose material the combination comprising a stationarily disposed sewing machine;

a holding unit including a suction tube for receiving a toe portion of a hose material thereover and a pair of finger pieces mounted for spreading movement adjacent said suction tube;

means for moving said finger pieces relative to said suction tube to flatten the toe portion while carrying the toe portion away from said suction tube into a position interposed in a stitching line of said sewing machine; and means for moving said holding unit parallel to said stitching line to move the toe portion past said sewing machine for closing of the toe portion.

14. An apparatus for closing the toe of a series of hose material comprising a stationarily disposed sewing machine;

a plurality of holding units disposed in an endless path, each holding unit including an elongated tube and a pair of finger pieces mounted for spreading movement adjacent said tube for receiving a hose material thereon;

means for moving said holding units in said endless path parallel to a stitching line of said sewing machine; and means for sequentially moving said finger pieces of each said holding means relative to said tube to flatten a toe portion of a hose material thereon while carrying the toe portion away from said tube to a position interposed in said stitching line of said sewing machine and then parallel to said stitching line then through said sewing machine during movement of said holding units in said endless path.

15. An apparatus as set forth in claim 14 which further comprises a plurality of pin devices for moving synchronously along with each respective holding unit in a parallel direction, each said pin device including at least one pin disposed between a respective pair of finger pieces, each said pin having a sharp point for piercing through and engaging a hose material on said finger pieces whereby the engaged part of the hose material is held by said pin device during movement of said toe portion to said position in said stitching line.

16. An apparatus as set forth in claim 14 wherein said holding units are disposed in pairs to close the toe portions of two pieces of hose material forming one united panty hose.

17. An apparatus as set forth in claim 14 wherein each said tube is hollow and has a lateral opening near an outer end, and which further comprises means for winding-on of a hose material on said tube from within said tube and a photocell-type detecting device disposed outside said tube for controlling said winding-on means, said detecting device being disposed on a center line of said opening to direct a light beam through said opening whereby upon passage of the light beam through a portion of the hose material on said tube and deflection from a second portion of the hose material within said tube said winding-on means remains operative while upon detection of the movement of said second hose material portion from said centerline of said opening said winding-on means is stopped.

18. In an apparatus for automatically closing the toe of a hose material, the combination comprising a holding unit including a hollow suction tube for receiving a toe portion of a hose thereover;

a winding-on means for winding-on a hose material on said tube from within said tube; and a photocell-type detecting device disposed outside said tube for controlling said winding-on means, said detecting device being disposed to direct a light beam into the interior of said tube to detect the presence of the hose material therein whereby upon movement of the end of said hose material in said tube past said light beam, said detecting device emits a signal indicating the occurrence of such a condition to stop said winding-on means.

19. In an apparatus as set forth in claim 18 wherein said tube is made of transparent material.

20. In an apparatus as set forth in claim 18 wherein said tube has an opening near an outer end, and said detecting device directs said light beam on a centerline of said opening.

* * * * *